United States Patent [19]

Duboy

[11] Patent Number: 4,467,742

[45] Date of Patent: Aug. 28, 1984

[54] BATTERY-POWERED PROPULSION UNIT FOR A DIVER

[76] Inventor: Gustavo Duboy, 18801 NW. 49th Ct., Carol City, Fla. 33055

[21] Appl. No.: 402,146

[22] Filed: Jul. 26, 1982

[51] Int. Cl.[3] ..... B63C 11/02; B63C 11/46

[52] U.S. Cl. ..... 114/315; 440/6; 405/185

[58] Field of Search ..... 114/22, 315, 20 A, 20 R, 114/123; D21/237, 238; 405/185, 186; 403/302, 309, 313, 332, 361; 220/4 B, 4 E, 23.8, 23.4; 46/93, 94; 206/333; 224/902; 440/5, 6

[56] References Cited

U.S. PATENT DOCUMENTS

| | | | |
|---|---|---|---|
| 2,906,227 | 9/1959 | Smith | 114/22 |
| 3,034,467 | 5/1962 | Pestronk | 440/6 |
| 3,069,190 | 12/1962 | Henson | 403/361 |
| 3,274,476 | 9/1966 | Wildum | 224/902 |
| 3,329,118 | 7/1967 | Strader | 114/315 |
| 3,635,188 | 1/1972 | Rutkowski | 440/6 |
| 3,916,814 | 11/1975 | Bardoni et al. | 114/315 |
| 3,995,578 | 12/1976 | McCullough | 440/6 |
| 4,220,110 | 9/1980 | Roberson, Sr. et al. | 114/315 |

*Primary Examiner*—Trygve M. Blix
*Assistant Examiner*—Edwin L. Swinehart
*Attorney, Agent, or Firm*—Oltman and Flynn

[57] ABSTRACT

The present battery-powered propulsion unit for a diver's tank has an electric motor driving a propellor and mounted in a housing which is attachable to the lower end of the tank. A belt worn on the diver's waist carries first and second groups of battery holders, each made up of separable halves which are releasably attached to the belt on opposite sides of its buckle. The buckle carries a control switch for the motor which is connected by flexible cables to the motor and to the first and second groups of battery holders.

9 Claims, 9 Drawing Figures

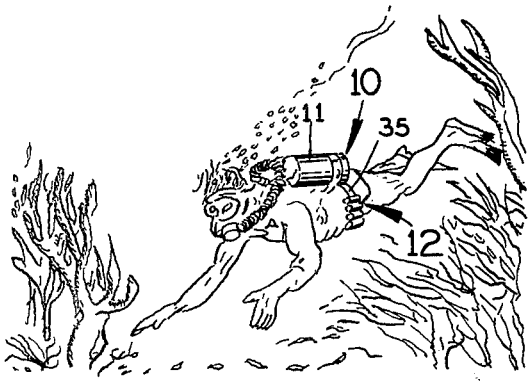
FIG. 1
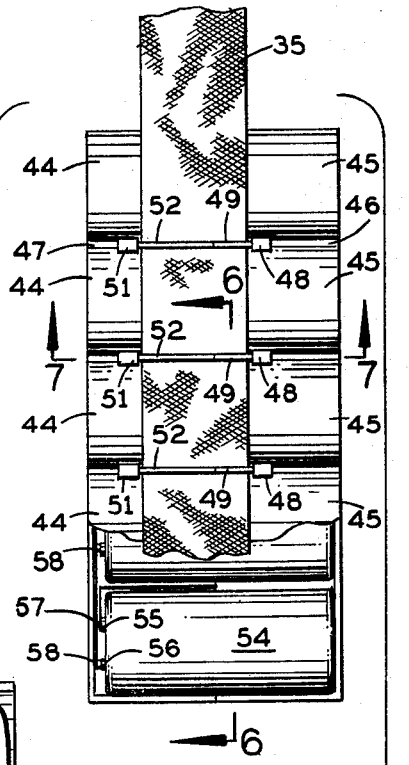
FIG. 2
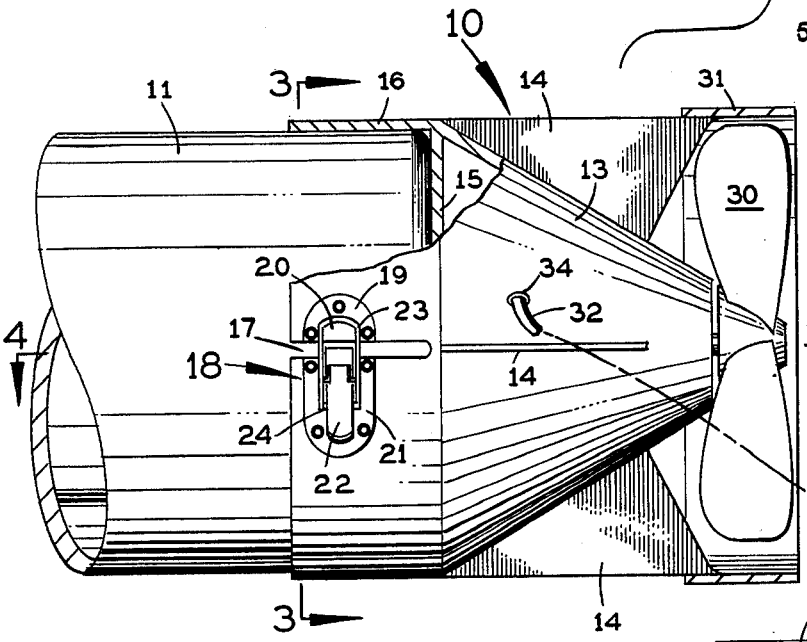
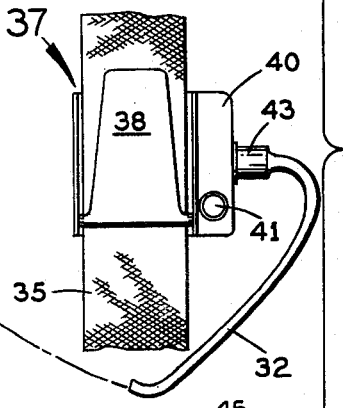
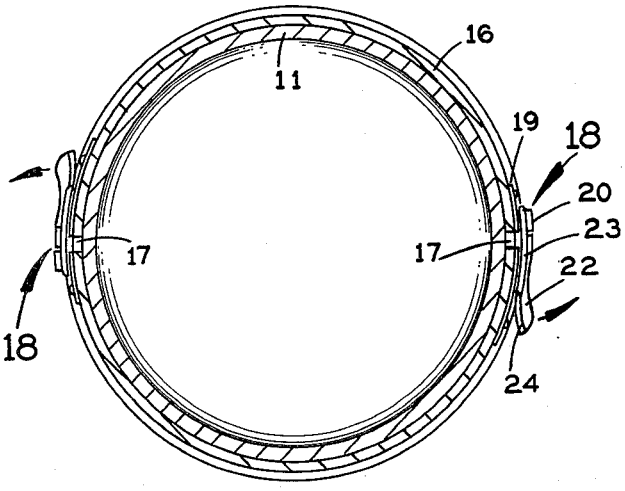
FIG. 3
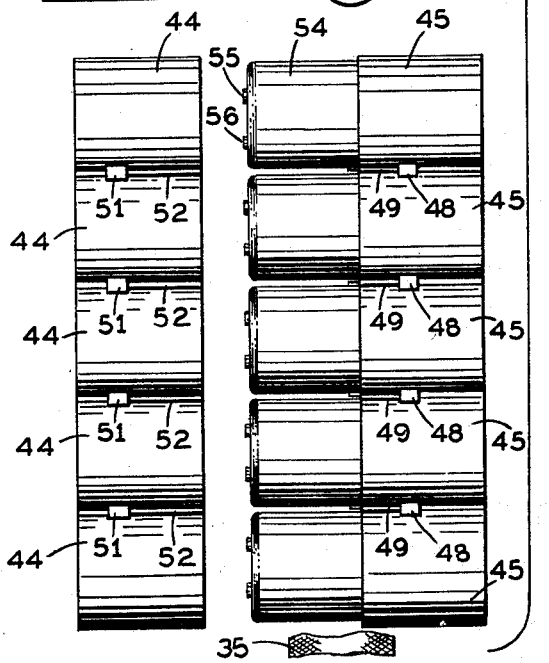

BATTERY-POWERED PROPULSION UNIT FOR A DIVER

SUMMARY OF THE INVENTION

This invention relates to a battery-powered propulsion unit for an underwater breathing apparatus having a tank worn on the diver's back.

A principal object of this invention is to provide a propulsion unit which is readily attachable to a conventional tank worn on the diver's back and is convenient for the diver to operate.

Another object of this invention is to provide in such a propulsion unit a water-tight battery holder carried by a belt worn around the diver's waist and connected electrically to a switch on the belt buckle for controlling an electric motor in the propulsion unit.

Another object of this invention is to provide a novel motor-operated propulsion unit for attachment to the lower end of a tank worn on the diver's back.

Further objects and advantages of this invention will be apparent from the following detailed description of a presently-preferred embodiment shown in the accompanying drawings. In this embodiment, the propulsion unit has an electric motor and a propellor carried by a housing which is releasably attachable to the lower end of the usual tank worn on the diver's back. A belt worn on the diver's waist carries batteries in two sets of flexibly interconnected battery holders located on opposite sides of the belt buckle. A control switch on the buckle is connected by cables to terminals in the battery holders and by another cable to the motor in the propulsion unit. With this arrangement, the weight and bulk of the batteries and their holders are conveniently distributed around the diver's waist and the control switch for the propulsion unit also is conveniently located at the waist.

DESCRIPTION OF THE DRAWING

FIG. 1 is a perspective view of a diver wearing an air tank equipped with the present propulsion unit;

FIG. 2 is an exploded view illustrating the different components of the present propulsion unit;

FIG. 3 is a cross-section taken along the line 3—3 in FIG. 2 through the lower end of an air tank equipped with the present propulsion unit;

Figure 4:
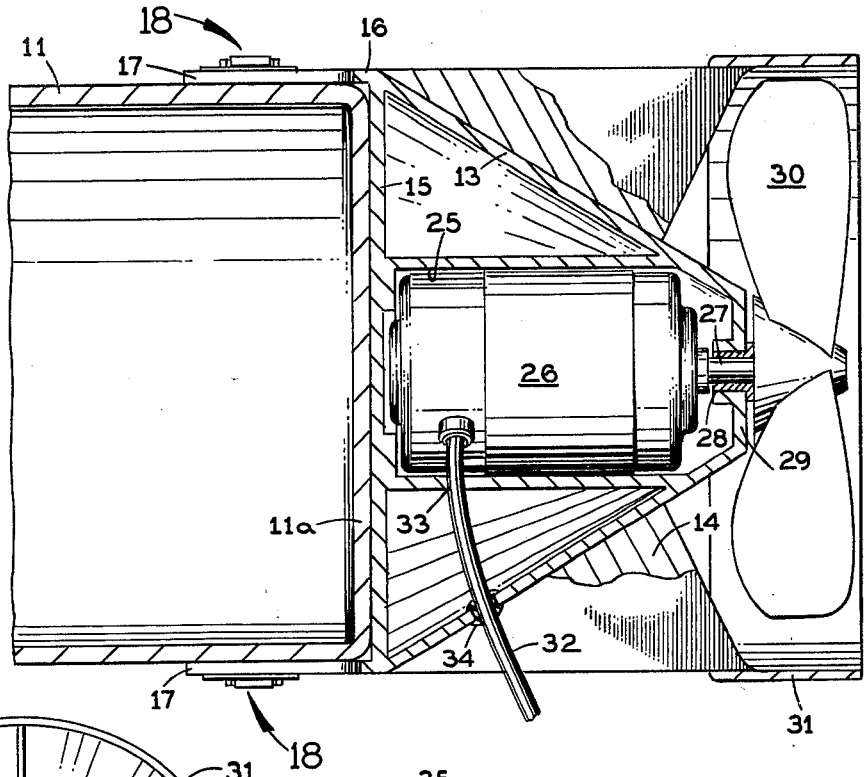
FIG. 4 is a longitudinal section taken along the line 4—4 in FIG. 2.
Figure 5:
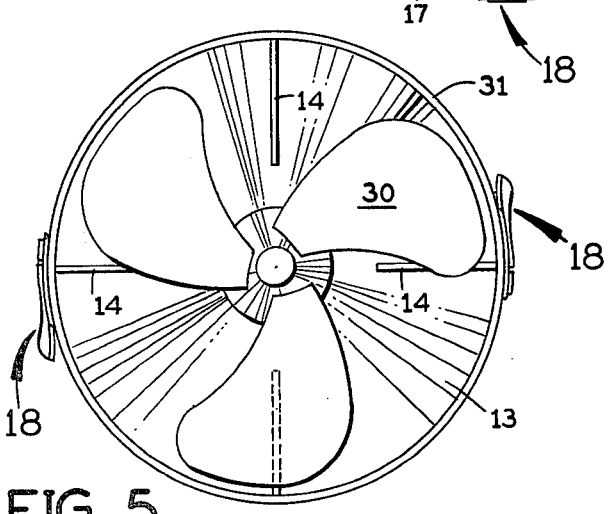
FIG. 5 is an end elevation taken from the right end of FIG. 4.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Referring to FIG. 1, the present invention comprises an electric motor-operated propulsion unit 10 for attachment to the lower end of an air tank 11, which is worn on the diver's back in the usual manner, and a battery pack 12 attached to a belt worn on the diver's waist and holding batteries for powering the motor in the propulsion unit.

As shown in FIGS. 2 and 3, the air tank 11 has a cylindrical side wall and a flat wall 11*a* (FIG. 4) at the bottom. The present propulsion unit 10 has a frusto-conical housing 13 enclosing an electric motor and carrying a plurality of radially outwardly-projecting longitudinal fins 14 on the outside. At its wider end the housing 13 presents a flat end wall 15 (FIG. 4) which is engageable with the bottom wall 11*a* of air tank 11, and beyond this end wall it presents a split cylindrical extension 16 which encircles the side wall of the air tank above its bottom wall. This cylindrical extension 16 is formed with diametrically opposed longitudinal slots 17 at which manually operable toggle clamps 18 are located. These clamps are adjustable between a released position, in which they permit the opposite halves of the cylindrical extension 16 to relax enough for slidable insertion onto the air tank, and a clamping position, in which they pull the opposite halves of the cylindrical extension 16 toward each other for clamping engagement with the side wall of the air tank.

As shown in FIGS. 2, and 3, each clamp 18 includes a first piece 19 affixed to the cylindrical extension 16 on one side of the corresponding longitudinal slot 17 and having a projection 20 formed with a peripheral groove. Each clamp also has a second piece 21 affixed to the extension 16 on the opposite side of slot 17 and pivotally supporting an operating handle 22 having its pivot axis parallel to and near the slot 17. A generally U-shaped, rigid wire 23 is pivotally coupled at 24 to the handle 22 and it extends across the slot 17 and is engageable in the peripheral groove in the projection 20 on the clamp piece 19 on the opposite side of this slot. When the handle 22 is pivoted counterclockwise in FIG. 3 it moves the wire 23 out of engagement with projection 20, thereby releasing the clamp. In the clockwise position shown in FIG. 3, the handle 22 holds the wire 23 tightly against the grooved projection 20.

As shown in FIG. 4, the housing 13 of the propulsion unit has a generally cylindrical internal axial chamber 25. An electric motor 26 is snugly received in this chamber. The motor has a rotary output shaft 27 extending through a water-tight anti-friction bushing or bearing 28 in a lower end wall 29 of housing 13. A propellor 30 is attached to the motor shaft 27 just beyond the end wall 29. A cylindrical shroud 31 is affixed to the vanes 14 and extends closely around the propellor 30.

A water-proof insulated cable 32 extends from the motor 26 through an opening 33 in the side wall of chamber 25 and through a water-tight fitting 34 at an opening in the frusto-conical outer wall 13 of the propulsion unit housing. This cable includes electrical wires for connecting the motor 26 to batteries in the battery-pack 12 on the diver's waist.

Figure 8:
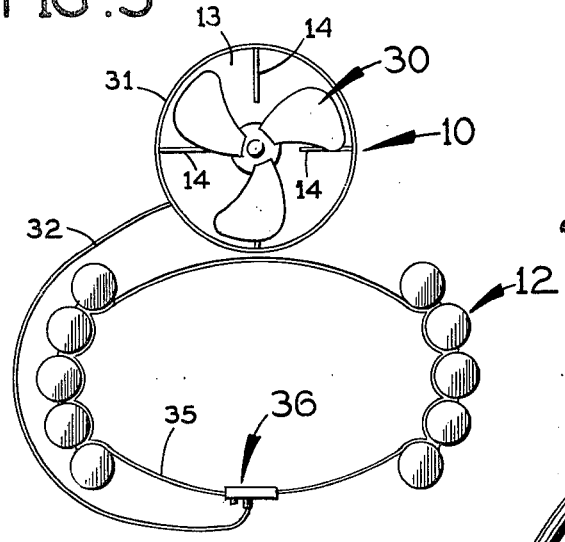
FIG. 8 is a schematic end elevational view of the battery-pack belt and the propulsion unit on the air tank.
Figure 9:
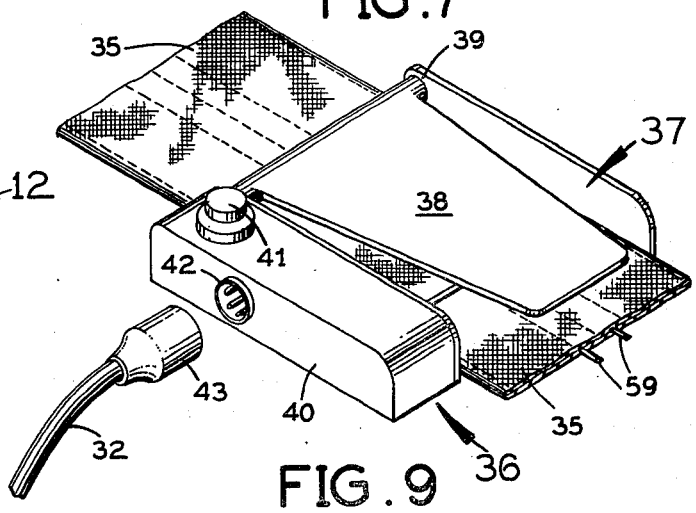
FIG. 9 is a fragmentary perspective view showing the buckle on the battery-pack belt and the electrical connector for the cable connecting the batteries to the electric motor in the propulsion unit.

As shown in FIGS. 8 and 9, a belt 35 of nylon or other suitable material extends around the user's waist and has its opposite ends overlapped at a buckle 36 of known design, such as the type of buckle used on automotive seat belts or on commercial aircraft. As shown in FIG. 9, the buckle has a rigid channel member 37 attached to one end of the belt and slidably receiving the opposite end of the belt. A handle 38 is pivoted at 39 to channel member 37 for adjustment between a retracted belt-clamping position, as shown in FIG. 9, and an extended position in which it projects away from channel member 37 and releases the free end of the belt.

As shown in FIG. 9, on one side the channel member 37 of the belt buckle carries a housing 40 in which is located an electrical switch operated by a push-button 41 and connected electrically to a pronged socket 42 located in the outer side of this housing. A complementary electrical connector 43 on the free end of cable 32 is insertable into socket 42 to connect the motor 26 in propulsion unit 10 to the switch operated by the push button 41 on belt buckle 36.

The battery pack 12 includes five water-tight battery holders on one side of the belt buckle 36 and five on the opposite side, each holding a two volt rechargeable battery. Each battery holder is of two-piece construction and is made up of opposite halves 44 and 45, as shown in the lower part of FIG. 2, each of which presents a cylindrical recess for snugly receiving the corresponding half of a battery 54. The battery holder members 44 are open at the right end in the lower part of FIG. 2 and the battery holder members 45 are open at the left end there. The opposite (outer) ends of the battery holder members 44 and 45 are closed so that when the battery holder members 44 and 45 are brought together end-to-end they provide water-tight compartments for the batteries.

Figure 6:
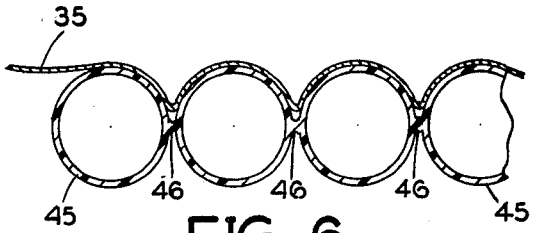
FIG. 6 is a longitudinal section through part of the battery-pack belt, taken along the line 6—6 in FIG. 2.
Figure 7:
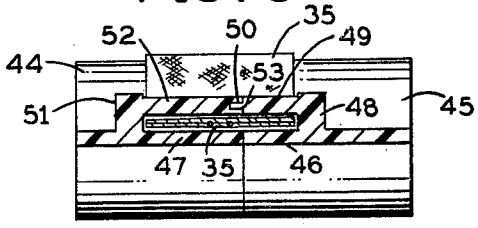
FIG. 7 is a cross-section through the battery-pack belt taken along the line 7—7 in FIG. 2.

As shown in FIG. 6, the battery holder members 45 are connected in parallel, closely spaced relationship by short flexible webs 46 extending diametrically between them. Preferably, the five battery holder members 45 and the connecting webs 46 are molded as an integral one-piece body of suitable plastic material. As shown in FIG. 7, each connecting web 46 extends the full axial length of the successive battery holder members 45 which it joins.

The opposite battery holder members 44 are similarly connected by webs 47 (FIG. 7).

The connecting webs 46 and 47 carry fingers for interfitting engagement with each other to hold the two halves of each battery holder together and hold the belt 36 assembled to the battery holders.

As shown in FIG. 7, each connecting web 46 for the battery holder members 45 is joined to a short outwardly projecting segment 48 located midway along its length. A finger 49 of solid cylindrical cross-section is joined to the outer end of segment 48 and extends from it toward the open end of the battery holder members 45 closely parallel to the connecting web 46. At its end away from segment 48, each finger 49 presents an extension 50 of reduced cross-section which projects slightly beyond the open end of battery holder members 45.

Similarly, each connecting web 47 for the battery holder members 44 is joined to a short outwardly projecting segment 51 located midway along its length. A finger 52 of solid cylindrical cross-section is joined to the outer end of segment 51 and extends from it directly toward, and in alignment with, a corresponding finger 49. Each finger 52 extends closely parallel to the web 47 to which it is attached by segment 51. At its end away from segment 51 each finger 52 presents a socket 53 which snugly receives the extension 50 on the corresponding finger 49.

As shown in the lower part of FIG. 2, the battery holder members 45 receive the base ends of respective batteries 54. The opposite end of each battery presents the usual battery terminals 55 and 56. As shown in the upper part of FIG. 2, the outer end wall of each of the other battery holder members 44 carries terminals 57 and 58 on the inside which engage the battery terminals when the opposite halves of the battery holder assembly are brought together to form compartments for holding the batteries.

The battery holder terminals 57 and 58 for adjoining batteries are connected conductively such that the five batteries 54 in each group are connected in series with each other, thereby providing a ten volt power supply.

The belts contain two layers with wires 59, connecting the battery holder terminals to the control switch in housing 40 on the belt buckle. The wires are between the layers. As shown in FIG. 2, there are two such wires 59 for each battery holder assembly on the belt 35 on opposite sides of the buckle 36. Preferably, the five series-connected two volt batteries in one battery holder assembly are connected electrically in parallel with the five series-connected two volt batteries in the holder assemblyon the opposite side of the belt buckle 36.

It will be evident that the complementary pins 49 and 52 connected to the opposite halves 45 and 44 of the battery holders provide a simple and convenient way of releasably assembling the opposite halves of the battery holders to each other, as well as to the belt 35. When battery replacement is needed, the unitary assembly of five battery holder halves 44 is disconnected from the unitary assembly of the five opposite halves 45 of the battery holder, permitting all five batteries to be replaced at the same time.

With this arrangement, the weight of the batteries and their holders is distributed around the diver's waist. The two sets of battery holders are readily attachable to and detachable from the belt 35. Whenever access to the batteries is necessary, such as for replacement of one or more batteries, the five battery holder members 44 on each side of the belt buckle can be readily separated as a unit from the five holder members 45 against which they fit to provide water-tight compartments for the batteries.

The control switch operated by push-button 41 is conveniently located on the belt buckle, where it is readily accessible to the diver.

The attachment of the propulsion unit 10 to the lower end of the air tank 11 keeps the combined center of gravity located substantially along the axis of the air tank, close to the diver's back so as not to detract substantially from the diver's freedom of movement and balance any more than the tank alone would.

I claim:

1. In a propulsion unit for underwater breathing apparatus including a tank worn on a diver's back, said apparatus having a housing, an electric motor in said housing, a propellor operatively coupled to said motor at one end of said housing, and means for mounting said housing on said tank, the improvement which comprises:

means for holding a plurality of batteries on the waist of a diver wearing the breathing apparatus;

and flexible cable means extending from said battery holding means to said motor for connecting the batteries electrically to the motor, said means for holding batteries further comprising:

a plurality of first battery holder members, each defining a tubular recess open at one end for receiving one end of a corresponding battery, means connecting said first battery holder members in close succession next to one another;

a plurality of second battery holder members, each defining a tubular recess open at one end for receiving the opposite end of a corresponding battery, means connecting said second battery holder members in close succession next to one another;

and a flexible belt coupled to said first and second battery holder members and holding them end-to-end with the recess in each second battery holder member registering with the recess in a corresponding first battery holder member to define a compartment for holding a corresponding battery;

said means connecting said first battery holder members comprising webs extending between successive first battery holder members;

and said means connecting said second battery holder members comprising webs extending between successive second battery holder members; and further comprising:

a plurality of releasable fingers attached respectively to said first and second battery holder members, said fingers extending closely parallel to the respective webs and engaging the outside of the belt to hold the belt tightly against the adjacent first and second battery holder members.

2. A propulsion unit according to claim 1, wherein said means for mounting said housing on the tank comprises means for releasably clamping the housing to the lower end of the tank to position the axis of the motor and propellor substantially aligned with the axis of the tank.

3. A propulsion unit according to claim 2, wherein said means for holding batteries comprises:

belt adapted to extend around the diver's waist;

a buckle operatively coupled to said belt for holding it encircling the diver's waist;

a first plurality of battery holders on said belt on one side of said buckle;

and a second plurality of battery holders on said belt on the opposite side of said buckle.

4. A propulsion unit according to claim 3, and further comprising:

means connecting said first battery holders in close succession along the belt to form a unitary assembly;

and means connecting said second battery holders in close succession along the belt to form a unitary assembly.

5. A propulsion unit according to claim 3, and further comprising:

a control switch for said motor mounted on said buckle;

a flexible electrical cable extending from said switch to said motor;

and flexible cables respectively extending from said switch to said first and second battery holders.

6. A propulsion unit according to claim 3, wherein each of said battery holders has first and second battery holder members which fit together to form a watertight compartment for receiving a battery and are separable from each other to permit access to the battery.

7. A propulsion unit according to claim 6, and further comprising means on each of said first and second battery holder members for releasable engagement with the belt to mount the battery holders on the belt.

8. A propulsion unit according to claim 7, and further comprising:

webs interconnecting the first battery holder members on one side of the buckle in close succession to form a unitary assembly;

webs interconnecting the second battery holder members on said one side of the buckle in close succession to form a unitary assembly;

webs interconnecting the first battery holder members on the opposite side of the buckle in close succession to form a unitary assembly;

and webs interconnecting the second battery holder members on said opposite side of the buckle in close succession to form a unitary assembly.

9. A propulsion unit according to claim 8, and further comprising:

a control switch for said motor mounted on the buckle;

a flexible electrical cable extending from said switch to said motor;

and flexible cables extending respectively from said switch to said first and second battery holders.

* * * * *